US006403712B1

(12) United States Patent
Ito et al.

(10) Patent No.: US 6,403,712 B1
(45) Date of Patent: Jun. 11, 2002

(54) PROCESS FOR THE MANUFACTURE OF SPANDEX AND THE SPANDEX MADE THEREBY

(75) Inventors: Shingo Ito; Toshikazu Matsuda; Masao Umezawa, all of Shiga (JP)

(73) Assignee: DuPont Toray Co. Ltd., Tokyo (JP)

( * ) Notice: Subject to any disclaimer, the term of this patent is extended or adjusted under 35 U.S.C. 154(b) by 0 days.

(21) Appl. No.: 09/509,861

(22) PCT Filed: Oct. 21, 1998

(86) PCT No.: PCT/US98/22271

§ 371 (c)(1),
(2), (4) Date: Jun. 7, 2000

(87) PCT Pub. No.: WO99/20818

PCT Pub. Date: Apr. 29, 1999

(30) Foreign Application Priority Data

Oct. 21, 1997 (JP) ..... 9-307874

(51) Int. Cl.[7] ..... D01F 6/70; D01F 6/94

(52) U.S. Cl. ..... 525/131; 264/172.14; 264/205

(58) Field of Search ..... 525/131; 264/172.14, 264/205

(56) References Cited

U.S. PATENT DOCUMENTS 3,287,441 A 11/1966 Magat ..... 260/857
5,002,474 A * 3/1991 Hoekstra ..... 425/72.2

FOREIGN PATENT DOCUMENTS

WO WO 95 23883 A 9/1995 ..... D01F/6/70

OTHER PUBLICATIONS

Database WPI, Section Ch, Week 7516, Derwent Publications Ltd., London, GB; Class A25, AN 75–26387W, XP002093846 & JP 48 080150 A (ASAHI CHEM IND CO LTD), Oct. 26, 1973.

* cited by examiner

*Primary Examiner*—Patricia A. Short

(57) ABSTRACT

Dry-spun polyurethane-based spandex ® containing 1–10 weight percent poly(vinylpyrrolidone) and a process of their preparation, are provided.

9 Claims, 1 Drawing Sheet

PROCESS FOR THE MANUFACTURE OF SPANDEX AND THE SPANDEX MADE THEREBY

BACKGROUND OF THE INVENTION

1. Field of the Invention

The present invention is related to a process for making a dry-spun spandex and, more particularly, to the use of poly(N-vinyl-2-pyrrolidone) with elastomeric segmented polyurethanes for the dry-spinning process.

2. Description of Background Art

Because of its excellent stretch characteristics, spandex is extensively used in garments such as legwear, innerwear, and sportswear. Reliable fiber spinning is economically advantageous during manufacture of the fiber because waste is reduced.

Japanese Published Patent Application 48-80150 discloses the use of poly(N-vinyl-2-pyrrolidone) in making wet-spun polyurethane- and polyurethaneurea-based spandex to improve whiteness retention.

There is a need for a polyurethane which has very good dry-spinnability into spandex.

SUMMARY OF THE INVENTION

The process of this invention for preparing spandex comprises the steps of:

A. preparing a polymer solution of an elastomeric segmented polyurethane based on 1,1'-methylenebis(4-isocyanatobenzene), a polyether glycol selected from the group consisting of poly(tetramethyleneether) glycol and poly(tetramethyleneether-co-3-methyltetramethylene-ether) glycol, and a diol selected from the group consisting of ethylene glycol, 1,3-propane diol, and 1,4-butane diol;

B. adding to the solution prepared in step A 1–10% by weight of total polymer solids content a polymer selected from the group consisting of poly(N-vinyl-2-pyrrolidone) and PVP copolymers;

C. dry-spinning the solution prepared in step B to form spandex; and

D. winding up the spandex.

DETAILED DESCRIPTION OF THE INVENTION

Figure 1:
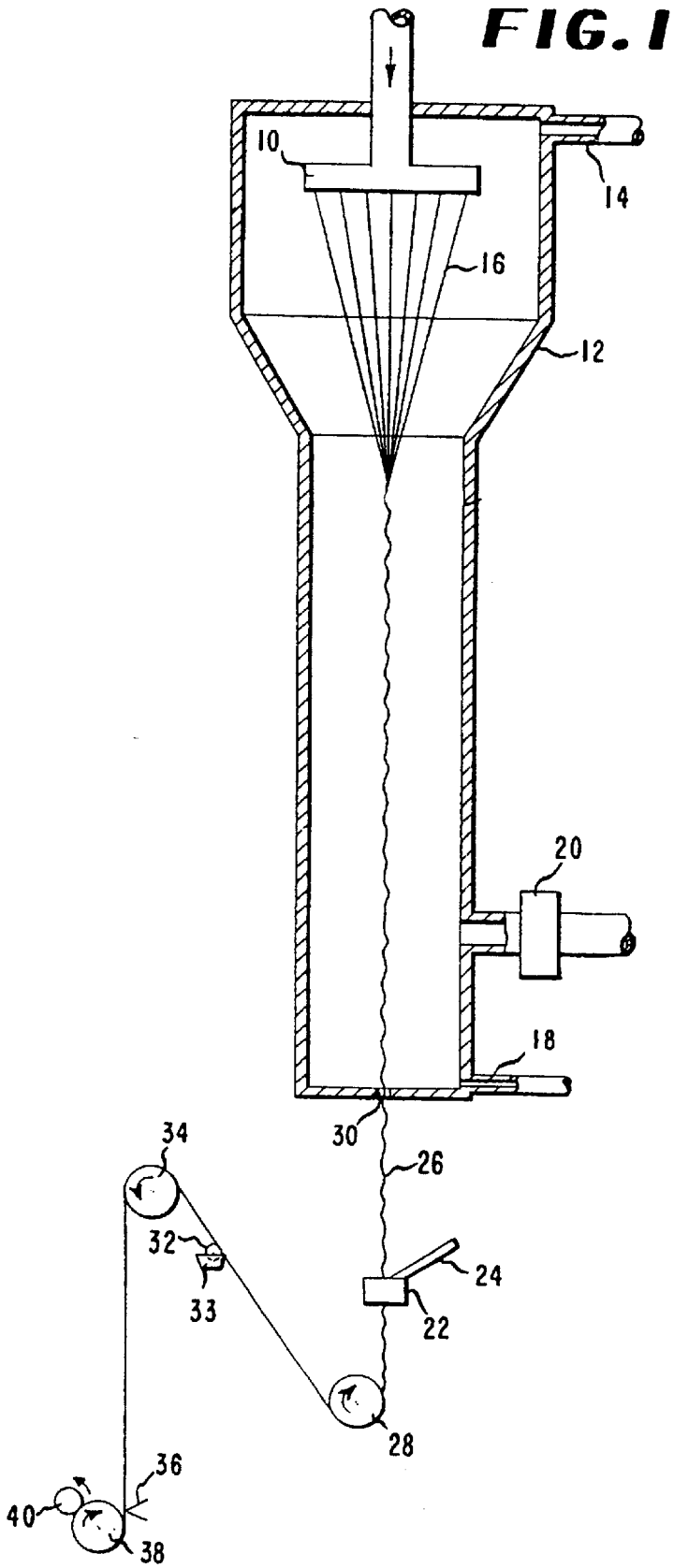
FIG. 1 illustrates a typical spinning cell, feed (godet) rolls, and windup in schematic form.

As used herein, spandex has its usual meaning, that is, a manufactured fiber in which the fiber-forming substance is a long chain synthetic elastomer comprised of at least 85% by weight of a segmented polyurethane. "Coalesced multifilament" means a fiber (or yarn) composed of a plurality of individual spandex filaments that have been adhered together, for example by having been passed through a coalescence jet.

The fiber-forming polymers used in the process of the present invention are polyurethanes. Polyurethane solutions can make spandex of marginal quality or can even be unspinnable in a dry-spinning process, especially when multiple filaments are combined to make higher decitex spandex. For example, along-end uniformity of the spandex, a sensitive measure of spinnability, can be inadequate for use in apparel applications such as hosiery. Surprisingly, it has now been found that the dry-spinnability and along-end uniformity of polyurethane-based spandex can be improved by adding poly(N-vinyl-2-pyrrolidone) and copolymers thereof to a dry-spinning solution. Such an effect is not observed with polyurethaneurea-based spandex.

The polyurethane polymers of this invention are prepared from a polymeric glycol, a diisocyanate, and a low-molecular weight diol chain extender. The polymers can be based on polyether glycols, polyester glycols, polycarbonate diols, and the like. Polyether glycols are preferred. More preferred are poly(tetra-methyleneether) glycol (hereinafter abbreviated as PO4G) and a modified PO4G which is a copolymer of tetrahydrofuran and 3-methyltetrahydro-furan (poly(tetramethyleneether-co-3-methyltetra-methyleneether) glycol), hereinafter abbreviated as 3MePO4G. When PO4G is used in the process of the present invention, it generally has a number average molecular weight in the range of about 1000–3000. 3MePO4G used in the present invention generally has a number average molecular weight of at least about 1500 but not more than about 8000, preferably at least about 2500 but not higher than about 6000, and more preferably of about 3000–4000. The 3MePO4G has a 3-methyltetramethyleneether moiety content of about 4–20 mole percent.

The diisocyanates used in this invention can be aromatic diisocyanates such as 1,1'-methylenebis(4-isocyanatobenzene) (hereafter abbreviated as MDI). MDI is used in a molar ratio of diisocyanate to homopolyether glycol (the "capping ratio") of about 1.5–4.0; the capping ratio when copolyether glycol is used is about 2.4–4.5, preferably about 3.0–4.0. The low molecular weight diol chain extender is ethylene glycol, 1,3-propanediol, 1,4-butanediol (abbreviated hereinafter as "2G", "3G", and "4G" respectively), and mixtures thereof.

Attaining the desired properties in the spandex can be accomplished by adjusting the composition and ratios of the polymeric glycol, diisocyanate, and chain extender. For example, if the molecular weight of the polymeric glycol is high, the relative amount of diisocyanate (that is, the capping ratio) should be high. Similarly, if the chain extender has a high molecular weight, the relative amount of chain extender should be low.

There are two general methods of preparing the polyurethanes used in the process of the present invention. In one general method, a polyurethane is prepared in the melt, dissolved in a solvent to obtain a polyurethane solution, and then dry spun. This is the "melt polymerization-and-dissolution" method. In a second general method, a polyurethane is synthesized directly in a solvent. As it is formed, the polyurethane dissolves in the solvent to form a solution that is then dry spun. This is the "solution polymerization" method. There are variants to each general method.

For example, the polyurethane can be produced by first reacting a polyether glycol with a diisocyanate to form an isocyanate-terminated glycol which is then reacted with a diol in the absence of a solvent to effect chain extension (the "two-step melt" method). In a second variant, a suitable polyether glycol, a suitable diisocyanate, and a suitable diol chain extender can be reacted at substantially the same time in the absence of solvent to synthesize the polyurethane (the "one-step melt" method). Note that there are no particular limitations on these processes when different kinds of polyols, diisocyanates and diols are used, or when polyol mixtures of different molecular weights are used. However, when substances of widely differing reaction rates are employed, it is preferable to react them separately and then mix the reaction products together.

The melt-prepared polyurethane used in making fibers of the invention can then be dissolved in the solvent by conventional techniques. Typical methods include mixing and dissolution by stirring, ultrasound, high speed shearing and the like. When necessary, a dissolution adjuvant also may be used. The use of a polyurethane in the form of a powder or small chips facilitates dissolution of the polyurethane.

Similarly, when the polyurethane is prepared directly in a solvent, the polyether glycol and the diisocyanate can be mixed and reacted to form an isocyanate-terminated prepolymer. There are no particular restrictions on the methods used for this reaction, which include ordinary stirring, subjecting the solution to ultrasound during stirring, and/or using a homogenizing mixer, a static mixer, a biaxial extruder, a kneader or the like. The isocyanate-terminated ("capped") glycol can then be dissolved in a solvent. It is convenient if the solvent for the capped polyol is the same solvent as will be used for making the polyurethane solution that is to be dry spun. A diol can then be added to effect chain extension. This is the "two-step solution polymerization method". The process of forming the polyurethane directly in a solvent may also be performed in one step, for example by dissolving the polymeric glycol and diol in a solvent and then adding diisocyanate to effect polymerization. This is the "one-step solution polymerization method".

When preparing diol-extended polyurethanes used in the process of the present invention, it can be helpful to use one or a mixture of two or more amine catalysts or organometallic catalysts. Typical useful amine catalysts include, for example, N,N-dimethylcyclohexylamine, N,N-dimethylbenzylamine, triethylamine, N-methylmorpholine, N-ethylmorpholine, N,N,N',N'-tetramethyl-ethylene diamine, N,N,N',N'-tetramethyl-1,3-propane diamine, N,N,N',N'-tetramethyl-hexane diamine, bis-2-dimethyl amino ethyl ether, N,N,N',N',N'-pentamethyl-diethylene triamine, tetramethylguanidine, triethylene diamine, N,N'-dimethylpiperizine, N-methyl-N'-dimethyl aminoethylpiperizine, N-(2-dimethyl amino ethylmorpholine, 1-methylimidazole, 1,2-dimethylimidazole, N,N-dimethylamino-ethanol, N,N,N'-trimethyl aminoethylethanol amine, N-methyl-N'-2-(hydroxyethyl) piperizine, 2,4,6-tris(dimethyl aminomethyl) phenol, N,N-dimethyl aminohexanol, triethanol amine, and the like. Organometallic catalysts such as tin octanoate, dibutyltin dilaurate, dibutyl lead octanoate, and the like, can be used.

There are no particular restrictions on the solvent that is used to dissolve the polyurethane. However the solvent composition should include at least one solvent selected from the group consisting of dimethylacetamide ("DMAc"), dimethylformamide ("DMF"), and dimethylsulfoxide ("DMSO"). DMAc is preferred, both for the processes in which the polyurethane is first polymerized and then dissolved in a solvent, and for the processes in which the polyurethane is polymerized in a solvent. Regardless of which method is used to prepare the polyurethane solution, it typically has a solids concentration in the range of about 30 to 40 wt %.

After the polyurethane solution is formed, various additives for specific purposes optionally can be added to the solution, so long as the additives do not interfere with the effects of the invention. Among such additives are benzotriazole-based stabilizers, ultraviolet light absorbers, other light resistance agents, antioxidants, anti-tack agents, lubricants such as mineral oil and silicone oils, antistatic agents and the like. Other examples of additives include hindered phenolic stabilizers such as 2,6-di-t-butyl-4-methylphenol as a light stabilizer, an antioxidant such as "Sumilizer" GA-80 (made by Sumitomo Kagaku Kogyo KK), benzotriazoles including a variety of "Tinuvin" stabilizers (sold by Ciba Specialties), phosphorus chemicals such as "Sumilizer" P-16 (also made by Sumitomo), a nitrogen oxide trap such as HN-150 (manufactured by Nippon Hydrazine), a light stabilizer such as "Sumisorb" 300#622 (manufactured by Sumitomo), hindered amine stabilizers including various "Tinuvin" types, inorganic pigments such as titanium oxide, zinc oxide, carbon black and the like, metal salts such as magnesium stearate and barium sulfate, bacteriocides containing silver, zinc, or compounds thereof, deodorants, a variety of anti-static agents, cerium oxide, betaine, phosphoric acids, and so on.

In the process of the present invention, poly(N-vinyl-2-pyrrolidone) (hereinafter "PVP") and/or copolymers of vinyl-2-pyrrolidone are added to the polyurethane solution, so that the final spandex has a PVP or PVP copolymer content in the range of about 1–10 weight percent (preferably about 1.5–7 weight percent), based on the weight of the total polymer solids content (spandex). Examples of suitable comonomers that can be polymerized with N-vinyl-2-pyrrolidone to make PVP copolymers useful in the process of the invention include vinyl acetate and N-but-1-enyl-2-pyrrolidone. Any suitable method can be used for adding PVP or copolymers thereof to the polyurethane solution. Representative methods include using a static mixer, stirring, and the like. It is advantageous to add the PVP as a solution because doing so makes it easier to add and mix it uniformly into the polyurethane solution. The addition to the polyurethane solution can also be carried out with a simultaneous addition of the aforementioned chemicals such as a light stabilizer, an antioxidant, a pigment, or the like, for example as a slurry.

The "K value" of the PVP polymers used in this invention is 20–70 (preferably in 26–34) for best spinnability of polyurethane-based spandex. When the molecular weight of PVP is too low, the viscosity of the spinning solution may be excessively reduced, and threadline continuity may be lost during spinning. When the molecular weight of the PVP is too high, the spinning solution viscosity can become too high to spin. For a discussion of K value and its relationship to PVP molecular weight, see "PVP—A Critical Review of the Kinetics and Toxicology of Polyvinylpyrrolidone (Povidone)", B. V. Robinson, et al., Lewis Publishers, 1990. PVP is preferably synthesized in isopropyl alcohol solvent for improved PVP purity.

In the process of the present invention, the spinning solution containing the polyurethane and PVP is dry-spun to form the spandex and then wound up. As illustrated schematically in FIG. 1, the polyurethane spinning solution is extruded from a spinneret assembly 10 mounted in or on the dry-spinning cell 12. As the solution is extruded from the spinneret, it is met by a co-current stream of hot, inert gas (the "aspiration" gas) introduced to the cell through inlet 14. The solvent of the spinning solution is evaporated into the hot, inert gas, thereby converting the several streams of spinning solution into continuous spandex filaments 16 as they proceed down the cell. A countercurrent stream of Inert gas may also be introduced at the bottom of the cell through inlet 18. The two streams of inert gas, now containing evaporated solvent, are drawn off through an aspiration device 20 near the bottom of the cell.

The filament bundle exits through a hole 30 in the bottom of the cell and passes through an optional coalescence jet 22 to a first feed (godet) roll 28. The jet 22 is supplied with a flow of gas through inlet 24. The spandex then passes over optional finish roll 32 for optional application of a lubricant from optional reservoir 33, thence to a second feed (godet) roll 34, and thence to a windup apparatus comprising a traverse guide 36, optional drive roll 38, and cylindrical core or bobbin 40, onto which the spandex is wound.

Seven filaments 16 are illustrated in FIG. 1, but fewer (including two filaments) or more (including 3, 5, 12, 24, 48, or even more) filaments can be prepared and joined into a chosen number of coalesced multifilaments by passing them through a conventional coalescence jet. Monofilaments can also be produced by the process of the present invention. Geometries of spinning cells and arrangements of rolls other than those shown in FIG. 1 can be used.

The ratio of the speeds of the second godet roll (feed roll) to that of the windup roll is referred to herein as the "windup stretch ratio" of the spandex. The windup stretch ratio is in the range of about 1.15 to 1.65.

The process of the present invention provides an improvement in spinning continuity of polyurethane-based spandex, due to reduced breaks, lower twinning frequency of monofilaments, and less yarn migration (that is, less drift of the fibers into the aspiration gas removal system of the dry-spinning cell and less incorporation into adjacent coalesced multifilaments). The effect is more pronounced in coalesced multifilaments than in monofilaments, though some improvement is seen with monofilaments, too. Coalesced multifilaments usually have higher decitex, so that the effect can be more apparent at higher yarn decitex, that is, above 20 decitex, for example at 50 decitex, 77 decitex, and higher. The improvement can also be more marked when more filament ends are being spun, for example 24 ends versus 12 ends.

More subtle spinnability improvements are revealed by a decrease in the Coefficient of Denier Variability (hereinafter "CDV"). Reduced CDV indicates that the along-end uniformity of polyurethane-based spandex is improved, reflecting an improved spinning process. Although the effect on CDV of adding PVP is most marked in yarns having higher decitex, it can also be observed in smaller filaments.

The dry-spinning of polyurethaneureas, which are a particular sub-group of polyurethanes in which the chain extension is effected by a low-molecular weight diamine such as ethylene diamine (hereinafter "EDA"), does not benefit from the addition of PVP. At 1 wt % and 6 wt % PVP, the spinnability and CDV of polyurethaneurea-based spandex actually deteriorate, compared to a polyurethaneurea control having no added PVP.

The invention is described in more detail in the Examples.

The polyurethane/DMAc solution viscosity was determined in accordance with the general method of ASTM D1343-69 with a Model DV-8 Falling Ball Viscometer, (sold by Duratech Corp., Waynesboro, Va.), operated at 40° C.

To determine the amount of PVP present in the spandex, a 100 mg fiber sample was dissolved in 5 ml of DMAc. To the resultant solution was gradually added 20 ml of ethanol, whereupon the polyurethane (or polyurethaneurea, depending on the nature of the sample) component precipitated. The remaining solution was analyzed by high speed liquid chromatography. PVP was quantitatively determined using a predetermined calibration curve based on PVP solutions of known concentrations. The following equation was used to obtain the PVP content:

$$\text{Weight\% PVP} = \frac{\text{sample peak area}}{\text{calibration curve}} \times \frac{\text{calibration sample weight}}{\text{fiber sample weight}}$$

fabric area

To measure CDV, the spandex was removed from a package using a rolling take-off and fed across a tensiometer comprising a piezoelectric ceramic pin. The take-up roll's circumference was 50% greater than the feed roll's circumference, and the feed and take-up rolls rotated at the same rpm, so that the polyurethane fiber was stretched to 50% elongation across the tensiometer. The tensiometer measured the tension as the multifilament was fed through the rolls. The average tension, variance, standard deviation, and coefficient of variance were calculated, and the coefficient of variance was reported as CDV, since the denier is directly proportional to the measured tension. A low CDV indicates high fiber uniformity and is a sensitive measure of spinning quality, since fiber non-uniformities arise during spinning.

All the polyurethanes used in the Examples were made by the one-step solution polymerization method but the other methods described hereinbefore can also be used. The polyurethaneureas used in Comparison Examples 7 and 8 were made by the two-step solution polymerization method. Stabilizing additives were incorporated into the spandex of the Examples and the Comparison Examples by conventional slurry addition and mixing during dry-spinning so that the fiber contained 2.0 wt % Methacrol(2462B (a polymer of bis(4-isocyan-atocyclohexyl)-methane) and 3-t-butyl-3-aza-1,5-pentanediol, made by DuPont), 1.2 wt % Methacrol (2390D (a condensation polymer of p-cresol and divinyl benzene, made by DuPont) and a small amount of silicone oil. Spinning speeds were measured at the windup roll.

EXAMPLES

In the Examples, 20 decitex spandex was a monofilament, 50 decitex spandex was comprised of three coalesced filaments, 44 decitex spandex had four coalesced filaments, and 77 decitex spandex was comprised of five filaments. PVP utilized K-value of 30 (available from International Specialty Products, Japan, or Kanto Kagaku, Japan or BASF, Germany).

In the Tables, "glycol" refers to the polymeric glycol used, "Comp" indicates a Comparison Example, "V" means Very, "n.m." means not measured, "Co-PVP" indicates that a copolymer comprising N-vinyl-2-pyrrolidone was used, and C.E. refers to the chain extender used.

The CDV of 20 decitex monofilament spandex in the Examples is about 9 to 10 without PVP and 6 to 8 with levels of PVP within this invention.

Example 1

Into 6050 g DMAc were put 2730 g of PO4G having a molecular weight of 2100, 977 g of MDI (capping ratio 3.0), and 161 g of ethylene glycol. The mixture was then heated to 70 (C and stirred for 7 hours. This is an example of the one-step solution polymerization method. Butanol (20 g) was added to terminate the polymerization. The molecular weight of this polymer was about 85,000, and the resulting polyurethane/DMAc solution (39% concentration by weight) viscosity (measured by Falling Ball Viscometry) was about 3800 poise. A spinning solution was prepared by adding 61.8 g of a DMAc solution of PVP (made by Kanto Kagaku, 40% PVP concentration by weight) and the additive slurry to 2000 g of the polyurethane/DMAc solution and stirring the mixture for 2 hours. The spinning solution was dry spun at a speed of 540 m/minute with a ratio in rotational speeds between the second godet roll and the windup roll (the "windup stretch ratio") of 1.40 to give 20 decitex spandex containing 2.7 wt %

Comparison Example 1A

A spinning solution was obtained by adding 19.9 g of a DMAc solution (40% concentration by weight) of PVP (Kanto Kagaku) to 1967 g of the same polyurethane solution as in Example 1, followed by stirring for 2 hours. 20 decitex spandex containing 0.8 wt % PVP was obtained by dry spinning the resulting spinning solution at a speed of 540 m/minute and a windup stretch ratio of 1.40. There was little difference in CDV or other measures of spinnability between 0.8 wt % and 0% PVP at the low decitex, as indicated in Table I.

Example 2

A spinning solution was obtained by adding 63.0 g of a DMAc solution (40% concentration by weight) of PVP ("Rubiskol", made by BASF) to 1983 g of a polyurethane solution substantially the same as that of Example 1, followed by stirring for 2 hours. Spandex was dry-spun as in Example 2.

Comparison Example 1B

A polyurethane/DMAc solution (39% concentration by weight), prepared as in Example 1 but without PVP, was dry spun at a ratio in speeds between the second godet roll and the windup roll of 1.40 at a speed of 540 m/minute to give 20 decitex spandex.

TABLE I

| EXAMPLE | 1 | Comp. 1A | 2 | Comp. 1B |
|---|---|---|---|---|
| GLYCOL | P04G | PO4G | PO4G | POG |
| C.E. | 2G | 2G | 2G | 2G |
| PVP, wt % | 2.7 | 0.8 | 3.0 | 0 |
| Decitex | 20 | 20 | 20 | 20 |
| Spinnability | V.Good | Good | V.Good | Good |

As shown in Table I, adding PVP to solutions of homopolyether-based, ethylene glycol-extended polyurethane improved their dry-spinnability, even for 20 decitex monofilament spandex.

Example 3

A 40 wt % solution of PVP in DMAc was added to a polyurethane solution as described in Example 1 and stirred for 2 hours. The spinning solution was dry-spun at 540 m/min, using an aspiration gas temperature of 390 (C and a windup stretch ratio of 1.32. The resulting 50 decitex coalesced multifilament spandex contained 2.0 wt % PVP and had a desirably low CDV of 14.

Comparison Example 2

Example 4 was repeated, but no PVP was added to the spinning solution. The CDV was higher at 22.

Example 4

A polyurethane was prepared in DMAc solution as in Example 1; the solution was 39 wt % solids. A 40 wt % solution of PVP (Kanto Kagaku) in DMAc was added to the polyurethane solution and stirred for 2 hours. The spinning solution was dry-spun to give a 77 decitex coalesced multifilament spandex which had a PVP content of 2.0 wt %. The aspiration gas temperature was 420 (C, the windup stretch ratio was 1.32, and the spinning speed was 540 m/min.

Comparison Example 3

A polyurethane solution was prepared and dry-spun as in Example 4, but no PVP was added. Under the same spinning conditions as were used in Example 4, no spandex could be spun at all.

TABLE II

| EXAMPLE | 3 | Comp. 2 | 4 | Comp. 3 |
|---|---|---|---|---|
| GLYCOL | P04G | PO4G | PO4G | PCG |
| C.E. | 2G | 2G | 2G | 2G |
| PVP, wt % | 2.0 | 0.0 | 2.0 | 0.0 |
| Decitex | 50 | 50 | 77 | 77 |
| CDV | 14 | 22 | 30 | n.m. |

The results presented in Table II illustrate the benefit of adding PVP to the polyurethane solution when a coalesced multifilament is being dry-spun. At about 50 decitex, CDV improved from 22 to 14 when 2 wt % PVP was added. At about 77 decitex, no fiber could be collected in the absence of PVP, but when 2 wt % PVP was added, fiber could be dry-spun.

Example 5

Into 6000 g of DMAc were added 2900 g of PO4G having a molecular weight of 2900, 879 g of MDI (capping ratio 3.5), and 225 g of 1,4-butane diol. The solution was heated to 65 (C and stirred for 5 hours, after which 20 g of n-butanol were added to terminate the polymerization. The solution concentration was about 40% polyurethane by weight. The number-average molecular weight of the polymer was about 90,000, and the solution viscosity, as measured by Falling Ball Viscometry, was about 4400 poise. A spinning solution was obtained by adding the additive slurry and 62.2 g of a DMAc solution (40% PVP concentration by weight) of "Rubisko", PVP to 2011 g of the polyurethane/DMAc solution. The spinning solution was dry spun at a speed of 540 m/min and a windup stretch ratio of 1.40.

Comparison Example 4

A polyurethane/DMAc spinning solution, prepared as in Example 6 into which the additive slurry had been mixed but to which no PVP was added, was dry spun at a windup stretch ratio of 1.40 at a speed of 540 m/minute.

TABLE III

| EXAMPLE | 5 | Comp. 4 |
|---|---|---|
| GLYCOL | P04G | PO4G |
| C.E. | 4G | 4G |
| PVP, wt % | 2.9 | 0.0 |
| Decitex | 20 | 20 |
| Spinnability | V.Good | Good |

Table III shows that the dry-spinnability of a 1,4-butanediol-chain extended polyurethane was also improved when PVP was added to the polyurethane solution, even when 20 decitex monofilament was being spun.

Example 6

Into 6000 g of DMAc were added 2916 g of 3MePO4G having a 3-methyltetramethylene ether moiety content of 12.5 mole percent and a molecular weight of 3500, 837 g of MDI (capping ratio 4.0), and 225 g of 1,4-butanediol. The mixture was heated to 65 (C and stirred for 5 hours. Butanol (20 g) was then added to terminate the polymerization and form a polyurethane/DMAc solution having a 40% polymer concentration by weight. The number-average molecular weight of the polyurethane was 85,000, and the solution viscosity was about 4300 poise. A spinning solution was prepared by adding the stabilizer additive slurry and 55.4 g of a DMAc solution (40% PVP concentration by weight) of "Rubiskol" PVP to 1792 g of the polyurethane/DMAc solution, followed by stirring for 2 hours. The resultant solution was dry spun at a speed of 540 m/minute and a windup stretch ratio of 1.40.

Comparison Example 5

To the polyurethane/DMAc solution (40% polymer concentration by weight) of Example 6 was added the additive slurry but no PVP, and the resulting spinning solution was dry spun at a ratio in speeds between the second godet roll and the windup roll of 1.40 at a speed of 540 m/minute.

Example 7

A polyurethane-based spandex was prepared in a manner substantially the same as that of Example 6 except that the capping ratio was 3.0, the chain extender was ethylene glycol, and the level of PVP in the dry-spun spandex was 3.0 weight percent.

Comparison Example 6

The polyurethane solution of Example 7 was dry-spun but without adding PVP.

TABLE IV

| EXAMPLE | 6 | Comp. 5 | 7 | Comp. 6 |
|---|---|---|---|---|
| GLYCOL | 3MePO4G | 3MePO4G | 3MePO4G | 3MePO4G |
| C.E. | 4G | 4G | 2G | 2G |
| PVP, wt % | 2.9 | 0.0 | 3.0 | 0.0 |
| Decitex | 20 | 20 | 20 | 20 |
| Spinnability | V.Good | Good | V.Good | Good |

As shown in Table IV, the dry-spinnability of copolyetherurethane-based spandex was also improved by adding PVP to the spinning solution, even when a monofilament was being made.

Example 8

A 40 wt % solution of Ganex P-904 (a vinyl pyrrolidone/1-butenyl pyrrolidone 90/10 copolymer, International Specialty Products, Tokyo) in DMAc was added to the same polyurethane solution as in Example 1 and stirred for 2 hours. The spinning solution was dry-spun at 540 m/min with a windup stretch ratio of 1.40 to give a monofilament spandex of 20 decitex. Spinnability was very good. The spandex contained 2.6 wt % of the PVP copolymer.

Example 9

A 40 wt % solution of S-630 (a vinyl pyrrolidone/vinyl acetate copolymer, International Specialty Products) in DMAc was added to the same polyurethane solution as in Example 1 and stirred for 2 hours. The spinning conditions were as in Example 8, and spinnability was very good. The spandex contained 3.0 wt % of the PVP copolymer.

TABLE V

| EXAMPLE | 8 | 9 | Comp. 1B |
|---|---|---|---|
| GLYCOL | P04G | PO4G | PO4G |
| C.E. | 2G | 2G | 2G |
| PVP, wt % | 2.6 | 3.0 | 0.0 |
| Decitex | 20 | 20 | 20 |
| Spinnability | V.Good | V.Good | Good |

Table V shows that copolymers of PVP also have a beneficial effect on the dry-spinnability of polyurethanes.

Comparison Example 7

PO4G having a molecular weight of 1800 (9,000 g) and MDI (200 g) were mixed together (capping ratio 1.58), heated to 90° C., and stirred for two hours to prepare an isocyanate-terminated prepolymer. The prepolymer was cooled to room temperature. A 500 g portion of the prepolymer was dissolved in 1000 g of DMAc. 7.8 g of ethylene diamine and 1.17 g of diethylamine were dissolved in 80.7 g of DMAc, and the resulting solution was added with rapid mixing to the prepolymer solution. The resulting polyurethaneurea solution contained 33 wt % solids. A 33 wt % PVP solution in DMAc (98 g) was added to the polyurethaneurea solution. The spinning solution was dry-spun with an aspiration gas temperature of 420° C., a spinning speed of 670 m/min, and a windup stretch ratio of 1.21 to form a four-filament, 44 decitex coalesced spandex which contained 6.0 wt % PVP. CDV was 22.

Comparison Example 8

Comparison Example 7 was repeated, but PVP was omitted. CDV of the resulting spandex was 17, indicating better uniformity and better spinnability than when the PVP was present.

TABLE VI

| EXAMPLE | Comp. 7 | Comp. 8 |
|---|---|---|
| GLYCOL | P04G | PO4G |
| C.E. | 2G | 2G |
| PVP, wt % | 6.0 | 0.0 |
| Decitex | 44 | 44 |
| CDV | 22 | 17 |

Table VI shows that the presence of PVP in the dry-spinning solution of a polyurethaneurea had a deleterious effect even for a coalesced multifilament, which is contrary to what was observed with polyurethanes.

What is claimed is:

1. A process for preparing spandex comprising the steps of:

A. preparing a polymer solution of an elastomeric segmented polyurethane, based on 1,1'-methylenebis(4-isocyanatobenzene), a polyether glycol selected from the group consisting of poly(tetramethyleneether) glycol and poly(tetramethyleneether-co-3-methyltetramethyleneether) glycol, and a diol selected from the group consisting of ethylene glycol, 1,3-propane diol, and 1,4-butane diol;

B. adding to the solution prepared in step A 1–10% by weight of total polymer solids content a polymer selected from the group consisting of poly(N-vinyl-2-pyrrolidone) and PVP copolymers having a K value of 20–70;

C. dry-spinning the solution prepared in step B to form spandex; and

D. winding up the spandex.

2. The process of claim 1 wherein the spandex is a coalesced multifilament.

3. The process of claim 2 wherein the PVP polymer is added so that the spandex has a PVP polymer content of 1.5–7 percent, based on the weight of the spandex, and the spandex has a decitex of at least about 40.

4. The process of claim 3 wherein the spandex is wound up at a windup stretch ratio of 1.15–1.65.

5. The process of claim 3 wherein the polyether glycol is poly(tetramethyleneether-co-3-methyltetramethyleneether) glycol and the diol is selected from the group consisting of ethylene glycol and 1,4-butanediol.

6. The process of claim 5 wherein the polyether glycol has a 3-methyltetramethyleneether moiety content in the range of 4–20 mole percent and a number average molecular weight of 2500–6000.

7. The process of claim 3 wherein the polyether glycol is poly(tetramethyleneether) glycol and the diol is selected from the group consisting of ethylene glycol and 1,4-butanediol.

8. Spandex prepared by the process of claim 1.

9. Spandex prepared by the process of claim 6.

* * * * *